US009472880B2

(12) United States Patent
Omae et al.

(10) Patent No.: US 9,472,880 B2
(45) Date of Patent: Oct. 18, 2016

(54) TERMINAL CONNECTION STRUCTURE

(71) Applicant: Yazaki Corporation, Minato-ku, Tokyo (JP)

(72) Inventors: Takashi Omae, Kakegawa (JP); Hajime Kato, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/561,989

(22) Filed: Dec. 5, 2014

(65) Prior Publication Data

US 2015/0093945 A1 Apr. 2, 2015

Related U.S. Application Data

(63) Continuation of application No. PCT/JP2013/003586, filed on Jun. 6, 2013.

(30) Foreign Application Priority Data

Jun. 8, 2012 (JP) ..... 2012-130461

(51) Int. Cl.

| | |
|---|---|
| ***H01R 13/28*** | (2006.01) |
| ***H01R 13/22*** | (2006.01) |
| ***H01R 11/11*** | (2006.01) |

(Continued)

(52) U.S. Cl.

CPC ..... *H01R 13/22* (2013.01); *H01R 4/26* (2013.01); *H01R 11/11* (2013.01); *H01R 13/2464* (2013.01); *H01R 4/183* (2013.01)

(58) Field of Classification Search

CPC ... H01R 13/28; H01R 13/03; H01R 2103/00

USPC ..... 439/287, 886, 387, 825

See application file for complete search history.

(56) References Cited

U.S. PATENT DOCUMENTS

| | | | | |
|---|---|---|---|---|
| 730,186 | A | 6/1903 | Case | |
| 3,011,144 | A * | 11/1961 | Armentrout ..... | H01R 13/02 439/287 |

(Continued)

FOREIGN PATENT DOCUMENTS

| | | | |
|---|---|---|---|
| JP | 7500215 | A | 1/1995 |
| JP | 08-007967 | A | 1/1996 |
| JP | 9223533 | A | 8/1997 |

OTHER PUBLICATIONS

International Search Report of PCT/JP2013/003586 dated Sep. 19, 2013.

(Continued)

*Primary Examiner* — Abdullah Riyami
*Assistant Examiner* — Thang Nguyen
(74) *Attorney, Agent, or Firm* — Sughrue Mion, PLLC

(57) ABSTRACT

In a terminal connection structure, a male terminal and a female terminal are mutually connected by being butted to each other. The male and female terminals are to be connected with respective ends of electric wires. The male terminal includes a male contact portion formed into a curved shape opening on a side opposite to the female terminal. The female terminal includes a female contact portion formed into a curved shape opening on the male terminal side, the curved shape being configured to contact with an outer circumferential surface of the male contact portion. The female contact portion includes contact pieces protruding toward the male contact portion.

6 Claims, 6 Drawing Sheets

(51) Int. Cl.

| | |
|---|---|
| ***H01R 13/24*** | (2006.01) |
| ***H01R 4/26*** | (2006.01) |
| *H01R 4/18* | (2006.01) |

(56) References Cited

U.S. PATENT DOCUMENTS

| | | | | |
|---|---|---|---|---|
| 5,188,539 | A * | 2/1993 | Langdon | G02B 6/3817 385/53 |
| 5,586,898 | A * | 12/1996 | Anderson | H01R 13/629 439/287 |
| 6,305,962 | B1 * | 10/2001 | Maher | H01R 13/585 439/27 |
| 6,624,639 | B2 * | 9/2003 | Schiffer | H01R 24/44 324/538 |
| 6,669,489 | B1 * | 12/2003 | Dozier, II | B23K 20/004 257/E21.503 |
| 7,207,839 | B1 * | 4/2007 | Shelly | H01R 4/2404 439/585 |
| 2009/0011657 | A1 * | 1/2009 | Chang | H01R 13/426 439/733.1 |
| 2013/0217279 | A1 * | 8/2013 | Hemond | H01R 4/188 439/878 |
| 2013/0244486 | A1 * | 9/2013 | Ohsaka | H01R 12/57 439/581 |

OTHER PUBLICATIONS

Written Opinion of the International Searching Authority of PCT/JP2013/003586 dated Sep. 19, 2013.

Communication dated Jan. 26, 2016 from the Japanese Patent Office issued in corresponding Application No. 2012-130461.

Communication dated Nov. 17, 2015 from the Japanese Patent Office in counterpart application No. 2012-130461.

* cited by examiner

TERMINAL CONNECTION STRUCTURE

CROSS REFERENCE TO RELATED APPLICATIONS

This application is a continuation application of International Application No. PCT/JP2013/003586, filed on Jun. 6, 2013, which claims priority to Japanese Patent Application No. 2012-130461, filed on Jun. 8, 2012, the entire contents of which are incorporated by references herein.

BACKGROUND OF THE INVENTION

1. Field of the Invention

The present invention relates to a terminal connection structure in which a male terminal and a female terminal are connected by being butted to each other.

2. Description of the Related Art

Conventionally, a terminal connection structure is configured from a male terminal and a female terminal, which are connected to respective ends of electric wires. In this terminal connection structure, the male terminal and female terminal are connected by being butted to each other (see Japan Patent Application Laid-Open Publication No. 08-007967).

Specifically, the male terminal includes a tip end which is flatly formed and pushes the female terminal to contact therewith. The female terminal includes two terminal pieces. Each terminal piece is bent at its tip end which contacts with the male terminal. Each terminal piece has a circular cross section.

Accordingly, when the male terminal and the female terminal are mutually connected, the two terminal pieces are bent and contact with the male terminal. Specifically, two connections are formed between the male terminal and the female terminal. Therefore, it is possible to secure connection reliability between the male terminal and the female terminal.

SUMMARY OF THE INVENTION

However, in the conventional terminal connection structure as described above, the two terminal pieces are kept to be bent. It may increase a load to each terminal piece, and may reduce durability of the female terminal.

Additionally, in the conventional terminal connection structure as described above, the tip end of the male terminal is formed into a flat shape. This limits the number of electrical contacts between the male terminal and the female terminal. Especially, when the tilted female terminal would contact with the male terminal having the flat tip end, any of the two terminal pieces would insufficiently contact with the flat tip end of the male contact. In this case, the connection reliability will decrease.

An object of the present invention is to provide a terminal connection structure which is capable of increasing durability of a female terminal and is capable of securely increasing connection reliability between a male terminal and the female terminal.

An aspect of the present invention is a terminal connection structure comprising: a male terminal and a female terminal configured to be mutually connected by being butted to each other, the male and female terminals to be connected with respective ends of electric wires, the male terminal including a male contact portion formed into a curved shape opening on a side opposite to the female terminal, the female terminal including a female contact portion formed into a curved shape opening on the male terminal side, the curved shape of the female contact portion being configured to contact with an outer circumferential surface of the male contact portion, and one of the male contact portion and the female contact portion including contact pieces protruding toward the other of the male contact portion and the female contact portion.

Each contact piece may include: a base end fixed to the one of the male contact portion and the female contact portion; a tip end served as a free end; and a contact point formed between the base end and the tip end, the contact point being configured to contact with the other of the male contact portion and the female contact portion.

Rows of the contact pieces may be arranged in a longitudinal direction and a transverse direction According to the present invention, it is possible to provide a terminal connection structure which is capable of increasing a durability of a female terminal and is capable of securely increasing connection reliability between a male terminal and the female terminal.

DESCRIPTION OF THE PREFERRED EMBODIMENTS

Figure 1:
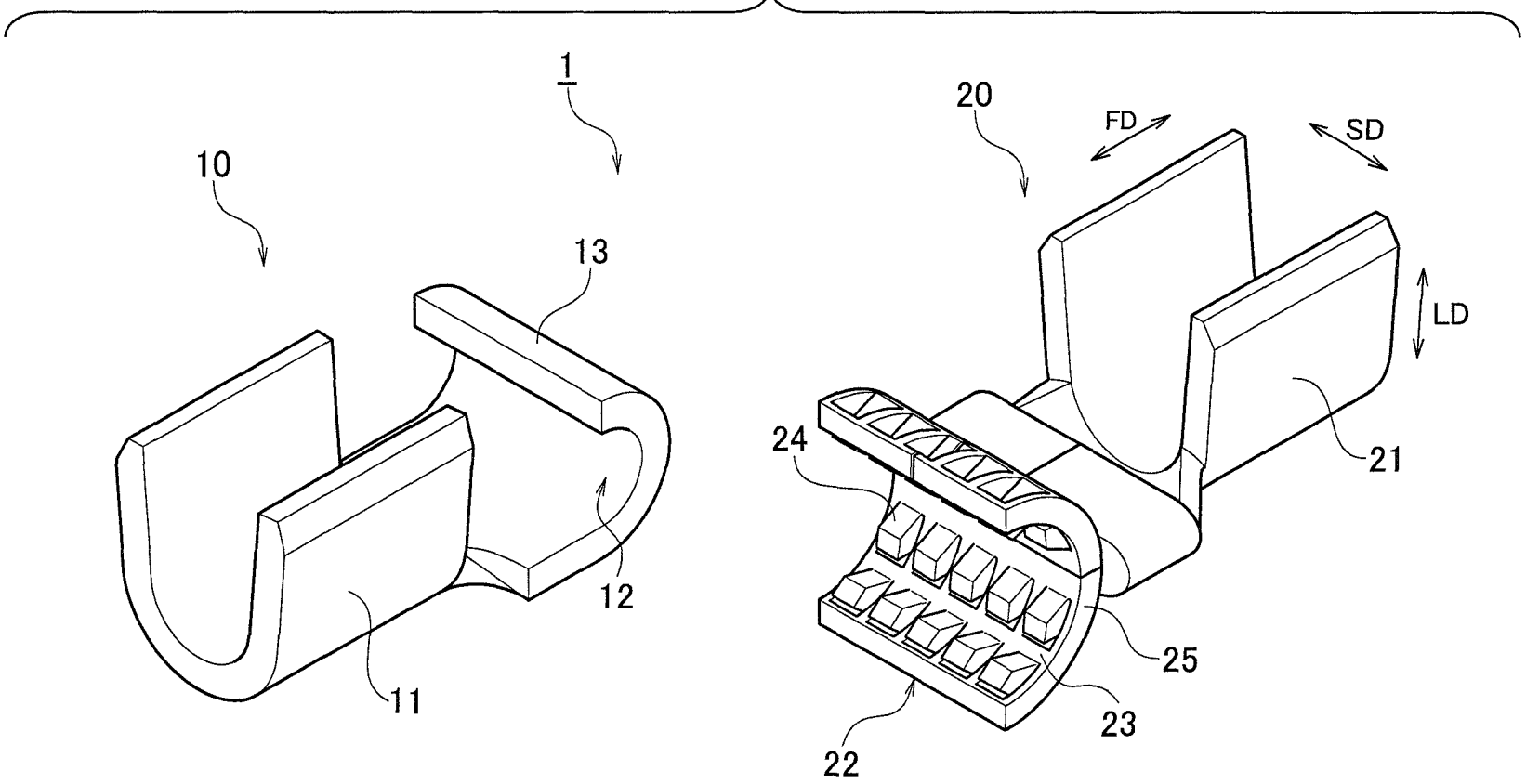
FIG. 1 is a perspective view illustrating a non-contact state of a terminal connection structure according to an embodiment of the present invention.

A terminal connection structure according to an embodiment of the present invention is described hereinafter with reference to drawings. Here, same or similar reference signs are applied to the same or similar parts in the drawings. The drawings are schematic, therefore, it should be noted that a proportion of each dimension in the drawings may be different from real dimension, and the concrete dimension should be determined with taking into consideration the following description. Further, the drawings may indicate different dimensions in some parts and may indicate different ratios of dimensions among the parts.

(Terminal Connection Structure)

Figure 2:
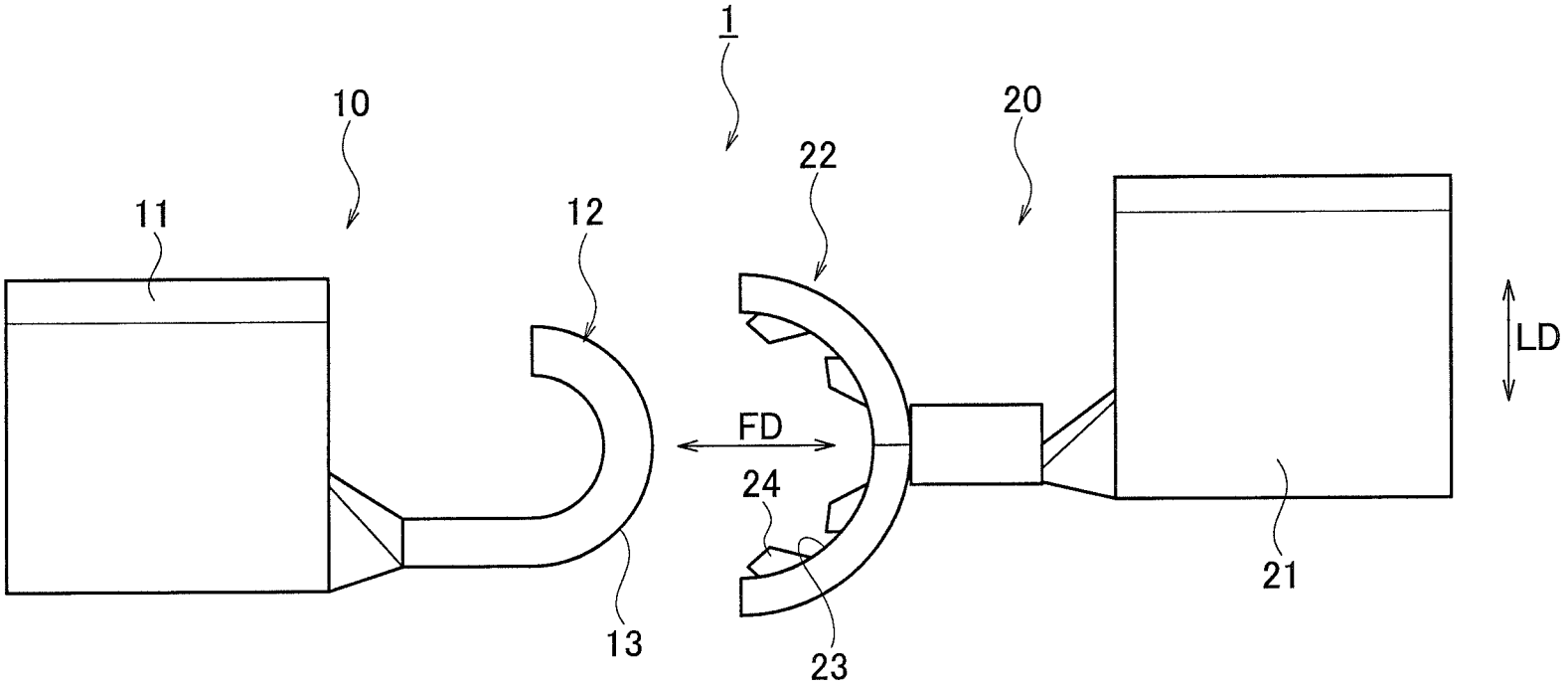
FIG. 2 is a side view illustrating a non-contact state of the terminal connection structure according to the embodiment of the present invention.
Figure 3A:
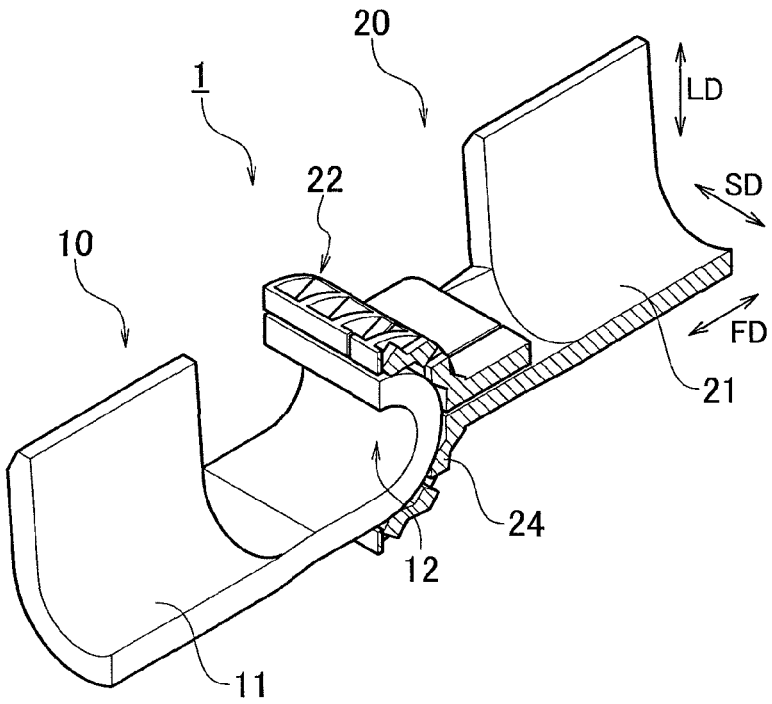
FIG. 3A is a perspective view illustrating a contact state of the terminal connection structure according to the embodiment of the present invention.
Figure 3B:
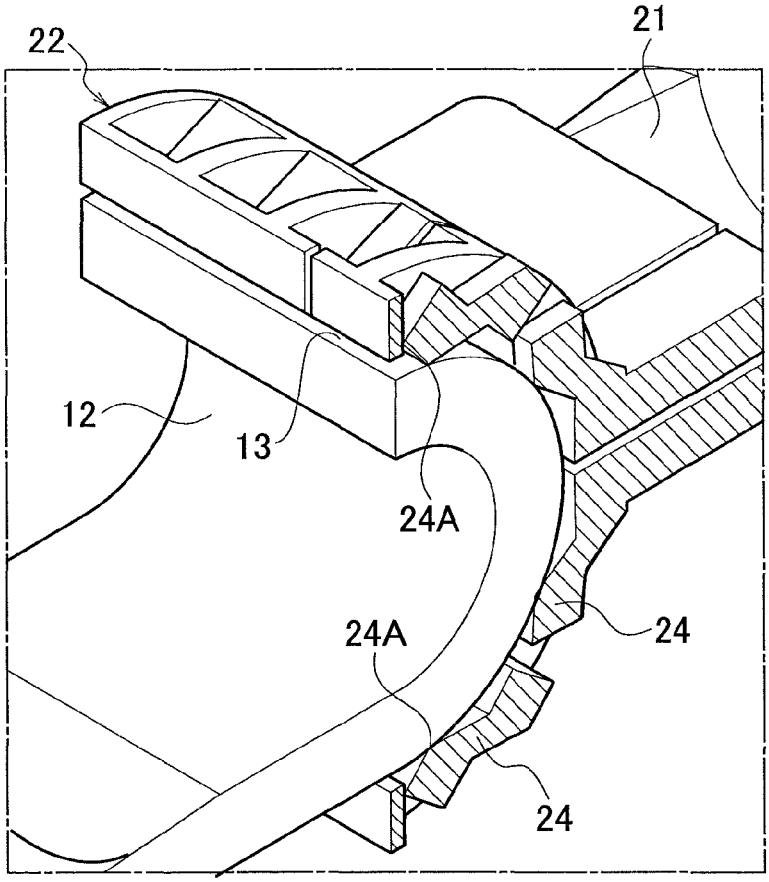
FIG. 3B is a perspective view illustrating the contact state of the terminal connection structure according to the embodiment of the present invention.
Figure 4A:
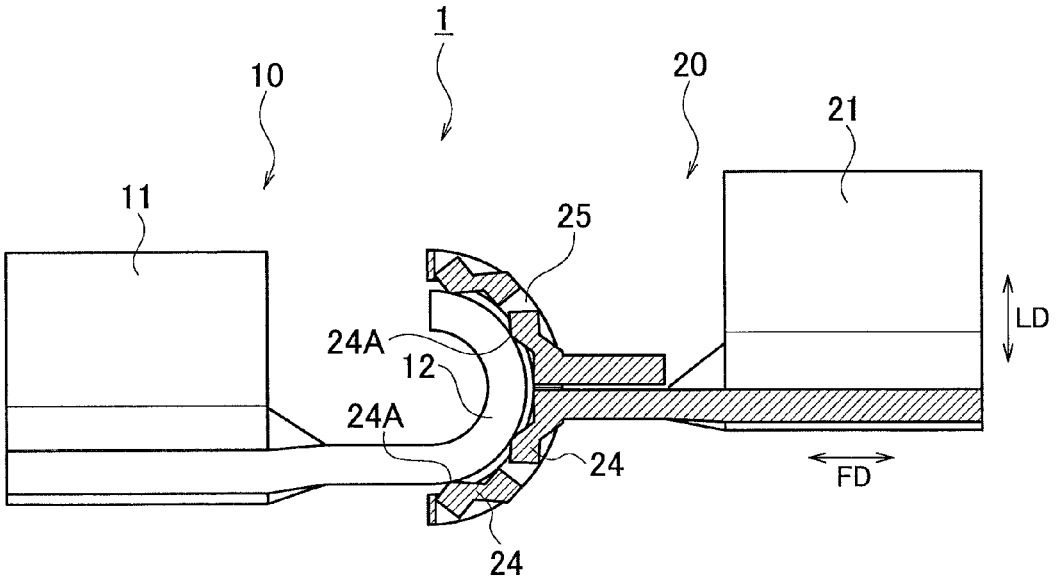
FIG. 4A is a side view illustrating a contact state of the terminal connection structure according to the embodiment of the present invention.
Figure 4B:
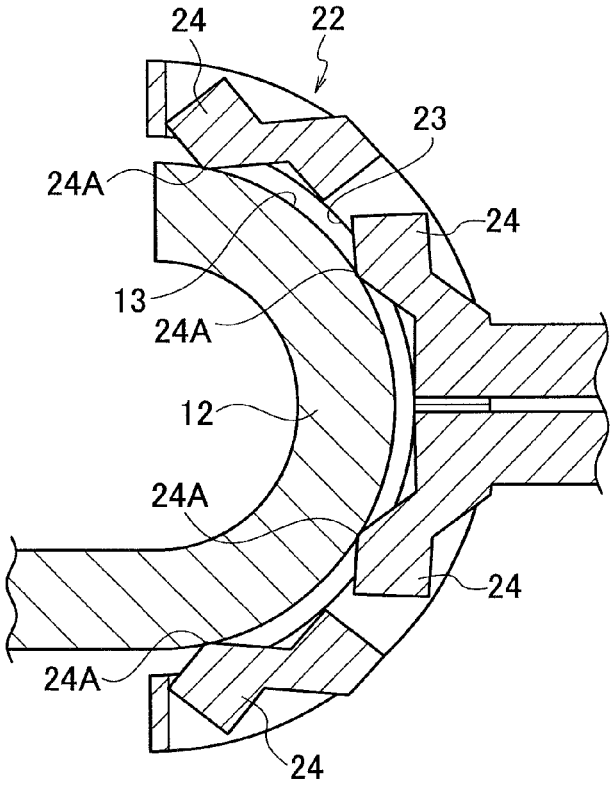
FIG. 4B is a side view illustrating the contact state of the terminal connection structure according to the embodiment of the present invention.
Figure 5A:
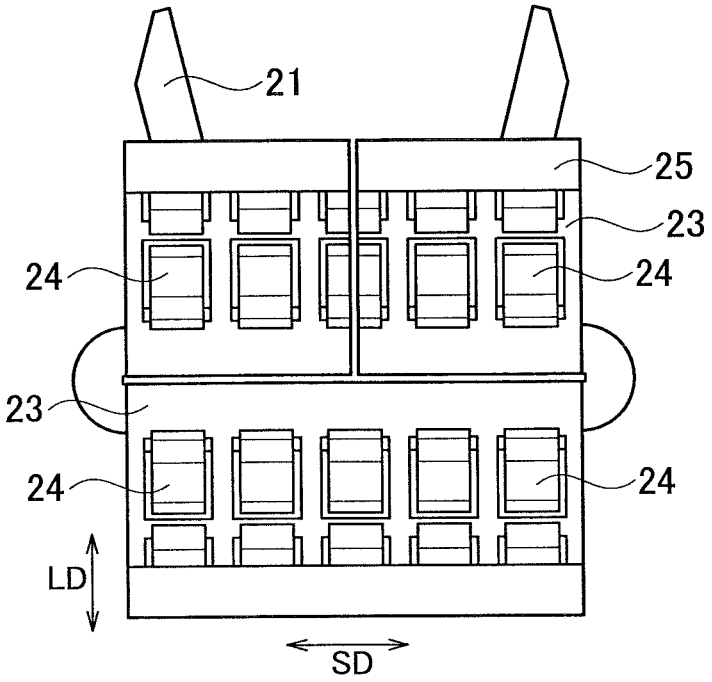
FIG. 5A is a front view only illustrating the female terminal according to the embodiment of the present invention.
Figure 5B:
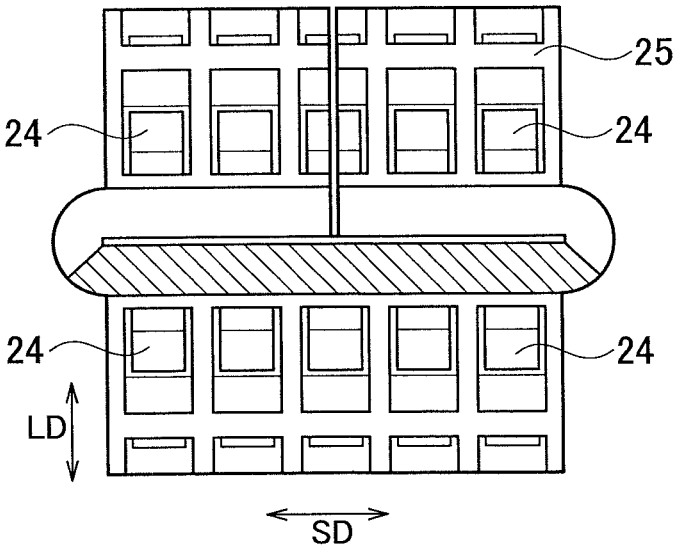
FIG. 5B is a back view only illustrating the female terminal according to the embodiment of the present invention.

A configuration of a terminal connection structure 1 according to the present embodiment will be described with reference to the drawings. FIGS. 1 and 2 are views illustrating a non-contact state of the terminal connection structure 1 according to the present embodiment. FIGS. 3 and 4 are views illustrating a contact state of the terminal connection structure 1 according to the present embodiment. FIG. 5A is a front view only illustrating a female terminal 20 according to the present embodiment. FIG. 5B is a back view only illustrating the female terminal 20 according to the present embodiment. The terminal connection structure 1 is supposed to be applied to a connector which connects electric wires attached to a male housing and a female housing, respectively.

As illustrated in FIGS. 1 to 4B, the terminal connection structure 1 comprises a male terminal 10 and the female terminal 20 each of which is connected to an end of an electric wire (not shown). The male terminal 10 and the female terminal 20 are mutually connected by being butted to each other.

The male terminal 10 is provided in a male housing (not shown). The male terminal 10 is made of an electrically conductive plate having a predetermined shape. The male terminal 10 is formed by bending of the plate. The male terminal 10 comprises: a wire connection portion 11 configured to be connected with an electric wire (not shown); a male contact portion 12 integrally provided with the wire connection portion 11, the contact portion 12 being configured to contact with the female terminal 20.

The wire connection portion 11 is formed by bending the plate at both side edges so as to erect therefrom. The wire connection portion 11 is crimped to the electric wire (not shown) to be fixed thereto. The male contact portion 12 is formed into a curved shape which opens on a side opposite to the female terminal 20. The male contact portion 12 includes an outer circumferential surface 13 to contact with the female terminal 20. Here, the male contact portion 12 of the embodiment has no uneven part.

The female terminal 20 is provided in a female housing (not shown) fitted to the male housing. As with the male terminal 10, the female terminal 20 is made of an electrically conductive plate having a predetermined shape, and is formed by bending of the plate. The female terminal 20 comprises: a wire connection portion 21 configured to be connected with an electric wire (not shown); a female contact portion 22 integrally provided with the wire connection portion 21, the female contact portion 22 being configured to contact with the male contact portion 12 of the male terminal 10.

The wire connection portion 21 is formed by bending the plate at both side edges so as to erect therefrom. The wire connection portion 21 is crimped to the electric wire (not shown) to be fixed thereto. The female contact portion 22 is formed into a curved shape which opens on the male terminal 10 side and is capable of contacting with the outer circumferential surface 13 of the male terminal 10. The female contact portion 22 includes an inner circumferential surface 23 on the male contact portion 12 side. The female contact portion 22 includes contact pieces 24 that protrude toward the male contact portion 12 from the inner circumferential surface 23.

As illustrated in FIGS. 5A and 5B, each contact piece 24 is formed into a rectangular shape when viewed from the front. Plural rows of the contact pieces 24 are arranged in a longitudinal direction LD and a transverse direction SD. Here, the longitudinal direction LD and transverse direction are normal to a fitting direction FD in which the male housing and the female housing are fitted to each other.

Each contact piece 24 is flexibly deformable and is integrally formed with a contact main body 25 formed into a lattice or the like when viewed from the front. Specifically, as illustrated in FIGS. 3B and 4B, each contact piece 24 includes a base end fixed to the contact main body 25 and a tip end served as a free end. That is, the contact piece 24 is formed to have a cantilever structure. A contact point 24A is formed between the base end and the tip end. The contact point 24A is formed most protruding toward a center of curvature of the female contact portion 22, and contacts with the male contact portion 12.

(Connection of Male Terminal and Female Terminal)

Figure 6A:
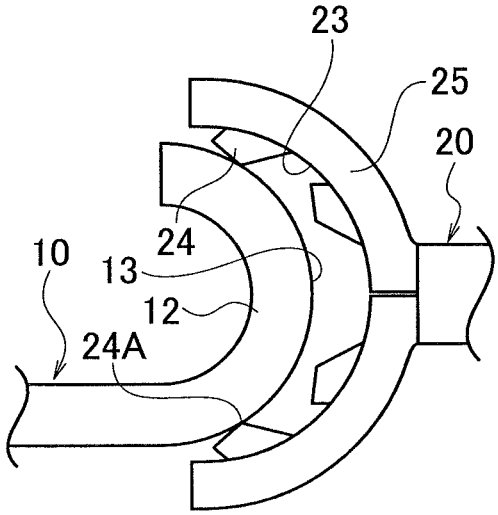
FIGS. 6A and 6B are side views illustrating connection states of the male terminal and the female terminal according to the embodiment of the present invention.
Figure 6B:
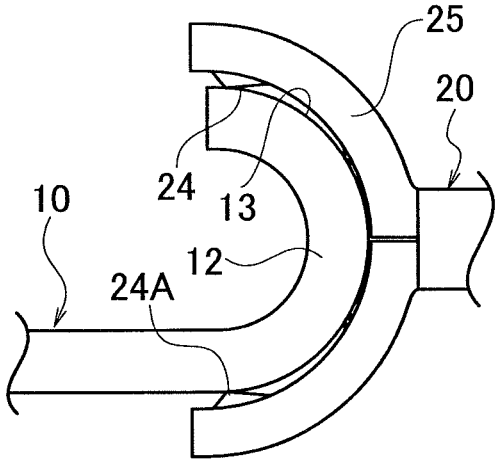

Connection of the aforementioned male terminal 10 and female terminal will be described with reference to the drawings. FIGS. 6A and 6B are side views illustrating connection states of the male terminal 10 and the female terminal 20.

When the male housing and the female housing are gradually fitted to each other and they are in a semi-fitting state, the male terminal 10 and the female terminal 20 approaches to each other, and the contact pieces 24 (contact points 24A) located at a tip end of (in other words, on an opening side of) the female contact portion 22 comes to contact with the male contact portion 12 as illustrated in FIG. 6A.

When the male housing and the female housing are further fitted to each other and they are in a fitting-completion state, the inner circumferential surface 23 of the female contact portion 22 comes to contact with the outer circumferential surface 13 of the male contact portion 12 as illustrated in FIG. 6B. The contact piece 24 of each female contact portion 22 contacts with the outer circumferential surface 13 of the male contact portion 12, thus bends. Accordingly, such deformation can absorb a tolerance between the outer circumferential surface 13 of the male contact portion 12 and the inner circumferential surface 23 of the female contact portion 22. Here, such tolerance is, for example, a fitting tolerance causing a relative offset between the male contact portion 12 and the female contact portion 22 in the insertion direction or in a direction normal to the insertion direction.

All of the contact pieces 24 contact with the male contact portion 12, and the male terminal 10 and the female terminal are mutually connected. Even if the tilted female terminal 20 would contact with the male terminal 10, all of the contact pieces 24 can contact with the male contact portion 12. Additionally, as illustrated in FIG. 6B, the outer circumferential surface 13 of the male contact portion 12 and the inner circumferential surface 23 of the female contact portion 22 are butted to each other, and this limits further contact therebetween. Therefore, excess deformation of each contact piece 24 can be suppressed.

(Operations and Advantageous Effects)

In the aforementioned embodiment, the female contact portion 22 includes the contact pieces 24 protruding toward the male contact portion 12 from the inner circumferential surface 23. Therefore, the number of contacts between the male terminal 10 and the female terminal 20 is increased. Consequently, compared with a load to conventional two terminal pieces, a load generated by contact between the male terminal 10 and the female terminal 20 effectively disperses to the contact pieces 24. Thus durability of the male terminal 10 and female terminal 20 can be improved.

The male contact portion 12 is formed into a curved shape. The female contact portion 22 is formed into a curved shape which can contact with the male contact portion 12. Therefore, even if the male terminal 10 and the female terminal 20 are contacted with each other while being tilted, the female contact portion 22 can securely contact with the male contact portion 12. Consequently, connection reliability of the male terminal 10 and the female terminal 20 can be securely improved.

In the present embodiment, the base end of each contact piece 24 is fixed to the contact main body 25, and the tip end thereof is formed as a free end. The contact points 24A is formed between the base end and the tip end to contact with the male contact portion 12. The contact points 24A contact with the outer circumferential surface 13 of the male contact portion 12, thus bend. Accordingly, a load generated by contact between the male terminal 10 and the female terminal 20 effectively disperses to the contact pieces 24. Thus, durability of the male terminal 10 and female terminal 20 can be improved.

In the present embodiment, the rows of the contact pieces 24 are arranged in the longitudinal direction LD and the transverse direction SD. Accordingly, the contact pieces 24 securely contact with the outer circumferential surface 13 of the male contact portion 12. Thus, connection reliability of the male terminal 10 and the female terminal 20 can be further improved.

Other Embodiments

The disclosure of the present embodiment has been made to explain the present invention. However, it should be noted that this disclosure does not limit the present invention. Specifically, this disclosure provides to the person skilled in the art various alternative embodiments and techniques.

For example, the present embodiment can be modified as follows. Specifically, in the above explanation, the terminal connection structure 1 is applied to connectors (not shown) for connecting electric wires respectively attached to a male housing and female terminal. Alternatively, this structure can be applied to others in which the male terminal 10 and the female terminal 20 are butted to each other and are mutually connected.

In addition, the contact pieces 24 may be provided in the male contact portion 12. The contact pieces 24 may be provided in at least one of the male contact portion 12 and the female contact portion 22. Specifically, they may be provided in both of the male contact portion 12 and the female contact portion 22.

In the present embodiment, the contact pieces 24 are arranged in the longitudinal direction LD and the transverse direction SD. However, rows of the contact pieces 24 may be aligned in any one of the longitudinal direction LD and the transverse direction SD.

Further, the contact points 24A may be provided at the tip ends of the contact pieces 24.

What is claimed is:

1. A terminal connection structure comprising:

a male terminal and a female terminal configured to be mutually and electrically connected by being butted to each other, the male and female terminals to be connected with respective ends of electric wires, the male terminal including an electrically conductive male contact portion formed into a curved shape opening on a side opposite to the female terminal, the female terminal including an electrically conductive female contact portion formed into a curved shape opening on the male terminal side, the curved shape of the female contact portion being configured to contact with an outer circumferential surface of the male contact portion to thereby provide electrical connectivity between the male terminal and the female terminal, and one of the male contact portion and the female contact portion including a plurality of flexibly deformable contact pieces protruding toward the other one of the male contact portion and the female contact portion.

2. The terminal connection structure according to claim 1, wherein each contact piece includes: a base end fixed to the one of the male contact portion and the female contact portion; a tip end served as a free end; and a contact point formed between the base end and the tip end, the contact point being configured to contact with the other of the male contact portion and the female contact portion.

3. The terminal connection structure according to claim 1, wherein rows of the contact pieces are arranged in a longitudinal direction and a transverse direction.

4. The terminal connection structure according to claim 2, wherein rows of the contact pieces are arranged in a longitudinal direction and a transverse direction.

5. The terminal connection structure according to claim 1, wherein the contact pieces are integrally formed with the one of the male contact portion and the female contact portion.

6. The terminal connection structure according to claim 1, wherein the contact pieces are formed to have a cantilevered structure.

* * * * *